US009771769B2

(12) United States Patent
Baker et al.

(10) Patent No.: US 9,771,769 B2
(45) Date of Patent: Sep. 26, 2017

(54) DEVICES AND RELATED METHODS FOR ACTUATING WELLBORE TOOLS WITH A PRESSURIZED GAS

(71) Applicant: Owen Oil Tools LP, Houston, TX (US)

(72) Inventors: Kevin L. Baker, Hillsboro, TX (US); Timothy E. LaGrange, Rainbow, TX (US)

(73) Assignee: OWEN OIL TOOLS LP, Houston, TX (US)

( * ) Notice: Subject to any disclaimer, the term of this patent is extended or adjusted under 35 U.S.C. 154(b) by 324 days.

(21) Appl. No.: 14/698,478

(22) Filed: Apr. 28, 2015

(65) Prior Publication Data

US 2015/0308236 A1 Oct. 29, 2015

Related U.S. Application Data

(60) Provisional application No. 61/985,158, filed on Apr. 28, 2014.

(51) Int. Cl.
*E21B 23/04* (2006.01)

(52) U.S. Cl.
CPC ..... *E21B 23/04* (2013.01)

(58) Field of Classification Search
None
See application file for complete search history.

(56) References Cited

U.S. PATENT DOCUMENTS 3,002,559 A * 10/1961 Hanes ..... E21B 23/065 166/120
3,186,485 A 6/1965 Owen
3,746,091 A 7/1973 Owen et al.
4,333,595 A 6/1982 Combette et al.
4,345,646 A * 8/1982 Terrell ..... E21B 23/04 166/212
5,024,270 A * 6/1991 Bostick ..... E21B 23/065 160/120
5,228,507 A 7/1993 Obrejanu et al.
5,396,951 A 3/1995 Ross
6,435,278 B1 8/2002 Barlow et al.
(Continued)

FOREIGN PATENT DOCUMENTS

EP 0672817 A1 9/1995
EP 1006259 A2 6/2000
(Continued)

OTHER PUBLICATIONS

PCT/US2015/028023—International Search Report dated Apr. 28, 2015.

*Primary Examiner* — Shane Bomar
(74) *Attorney, Agent, or Firm* — Mossman, Kumar & Tyler PC

(57) ABSTRACT

An apparatus for activating a wellbore tool includes a cylinder, a shaft, and a pressure dissipater. The cylinder has a first inner surface defining a smooth bore section and a second inner surface adjacent to the first inner surface. The shaft has a piston section that includes at least one seal forming a fluid seal with the first inner surface when the seal is at a nominal diameter. The pressure dissipater is formed along the second inner surface of the cylinder, the pressure dissipater contacts and physically destabilizes the at least one seal after the at least one seal exits the smooth bore section.

12 Claims, 3 Drawing Sheets

(56) References Cited

U.S. PATENT DOCUMENTS

| | | | |
|---|---|---|---|
| 7,469,750 | B2 | 12/2008 | Carr |
| 7,552,766 | B2 | 6/2009 | Gazewood |
| 8,534,367 | B2 | 9/2013 | Carisella |
| 2008/0296021 | A1 | 12/2008 | Robertson |
| 2012/0160483 | A1 | 6/2012 | Carisella |

FOREIGN PATENT DOCUMENTS

| | | | |
|---|---|---|---|
| WO | 0297234 | A1 | 5/2002 |
| WO | 2009058725 | A2 | 5/2009 |
| WO | 2014086962 | A2 | 6/2014 |

* cited by examiner

DEVICES AND RELATED METHODS FOR ACTUATING WELLBORE TOOLS WITH A PRESSURIZED GAS

CROSS REFERENCE TO RELATED APPLICATIONS

This application claims priority from U.S. Provisional Ser. No. 61/985,158, filed on Apr. 28, 2014, the entire disclosure of which is incorporated herein by reference in its entirety.

BACKGROUND OF THE DISCLOSURE

1. Field of Disclosure

The present disclosure relates to an apparatus and method for actuating a downhole tool with a pressurized gas.

2. Description of the Related Art

During the construction, completion, recompletion, or work-over of oil and gas wells, there may be situations wherein one or more well tools may need to be mechanically actuated in situ. One known method for actuating a well tool is to generate a pressurized gas using a pyrotechnic charge and then convey the pressurized gas into a device that converts the pressure into mechanical energy, e.g., a piston-cylinder arrangement that converts the pressure into motion of a selected tool or tool component. In aspects, the present disclosure is related to the need enhanced tools that use high pressure gas.

SUMMARY OF THE DISCLOSURE

In aspects, the present disclosure provides an apparatus for activating a wellbore tool. The apparatus may include a cylinder having a first inner surface defining a smooth bore section and a second inner surface adjacent to the first inner surface; a shaft having a piston section that includes at least one seal forming a fluid seal with the first inner surface when the seal is at a nominal diameter; and a pressure dissipater formed along the second inner surface of the cylinder, the pressure dissipater contacting and physically destabilizing the at least one seal after the at least one seal exits the smooth bore section.

In aspects, the present disclosure also provides a well tool that includes an upper sub, a pressure sub, and a lower sub. The upper sub has a housing that includes a first chamber for receiving an igniter. The igniter generates a flame output when detonated. The pressure sub has a cylinder, a shaft, a power charge, and a pressure dissipater. The cylinder has an inner surface defining a bore. The cylinder bore has a smooth bore section defined by an inner surface that is dimensionally non-varying both circumferentially and axially and a pressure chamber that generates the pressure needed to displace the cylinder in a direction away from the upper sub. The shaft is disposed in the cylinder bore and has a bore, a first end connected to the upper sub, and a second end on which a piston assembly is formed. The piston assembly includes at least one seal contacting the inner surface of the cylinder. The power charge is disposed in the shaft bore and is formed of an energetic material that generates a gas when ignited by the flame output of the igniter. The pressure dissipater is formed at a terminal end of the cylinder. The pressure dissipater contacts and physically destabilizes the at least one seal after the at least one seal exits the smooth bore section. The lower sub is connected to the cylinder and is configured to axially displace a component of the separate wellbore device.

The above-recited examples of features of the disclosure have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

Figure 1:
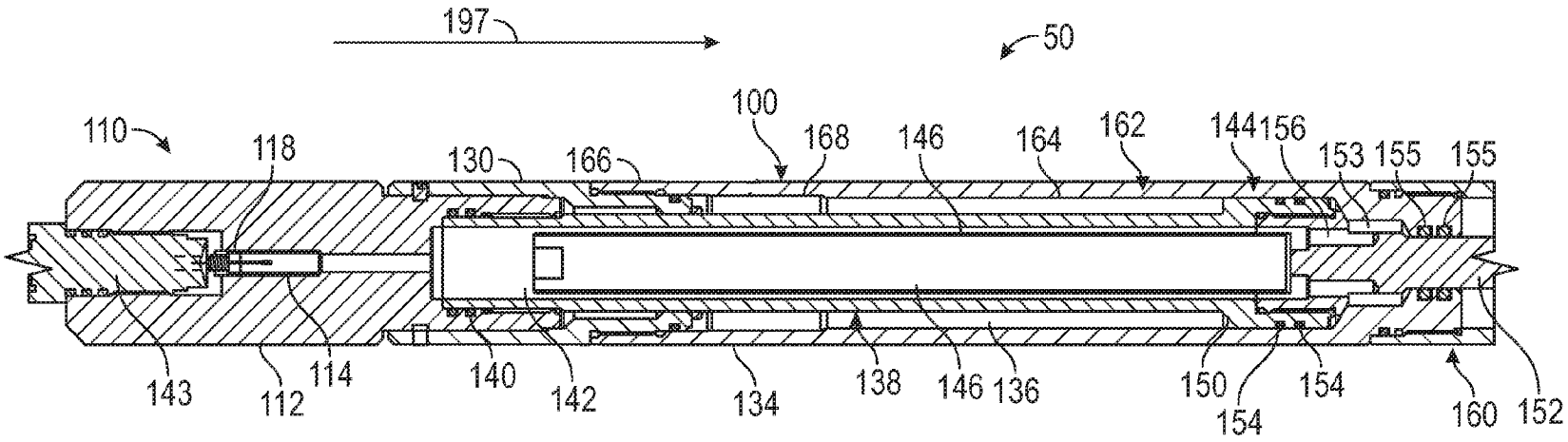
FIG. 1 is a schematic sectional view of one embodiment of a gas energized well tool according to one embodiment of the present disclosure.

As will become apparent below, the present disclosure provides an efficient device dissipating or bleeding off a high pressure fluid, such as a gas or gas/liquid used to actuate a wellbore tool. The present disclosure is susceptible to embodiments of different forms. There are shown in the drawings, and herein will be described in detail, specific embodiments of the present disclosure with the understanding that the present disclosure is to be considered an exemplification of the principles of the present disclosure, and is not intended to limit the disclosure to that illustrated and described herein.

Referring FIG. 1, there is shown one embodiment of a well tool 50 that uses a pressure dissipater 100 according to the present disclosure. Merely for ease of discussion, the well tool 50 is shown as a pyrotechnic actuator that is used to actuate a separate well tool (not shown) using a translating assembly. The well tool 50 may include an upper sub 110, a pressure sub 130, and a lower sub 160. The term "sub" is intended to generically refer to a section or a portion of a tool string. While a sub may be modular and use threaded connections, no particular configuration is intended or implied by the use of the term sub. Generally, the upper sub 110 generates a flame output that ignites a gas generating energetic material in the pressure sub 130. The pressure sub 130 maintains a fluid pressure in pressure chamber that may be energized by the high-pressure gas. In some embodiments, the pressure chamber may also include a liquid, such as hydraulic oil. The lower sub 160 converts the fluid pressure into the kinetic energy used to displace the lower sub 160. The lower sub 160 axially displaces a component of the separate wellbore device (not shown). Thus, the well tool 50 may be used to axially displace or otherwise move, shift, or load a separate wellbore device (not shown), which may be a packer, a swage, a bridge plug, etc.

The upper sub 110 includes a housing 112 that has a first chamber 114 for receiving an igniter 118. In one non-limiting embodiment, the igniter 118 may be a pyrotechnic device that generates a flame output when detonated by a suitable signal (e.g., electrical signal, hydraulic pressure, impact, etc.).

The pressure sub 130 may be formed as a piston-cylinder assembly wherein a cylinder 134 slides relative to a shaft 138 fixed to the upper sub 110. The shaft 138 has a first end 140 that connects with the upper sub 110, a bore 142, and a piston assembly 144. A power charge 146 disposed in the bore 142 may be formed of an energetic material that undergoes a deflagration when ignited by the flame output of the igniter 118. The energy from a deflagration primarily generates a gas at sufficient pressure and with enough volume to actuate the separate well tool (not shown). Shock waves are minimal, if not nonexistent, in a deflagration. The bore 142 is sealed with a device such as an adapter 143 in the upper sub 110 such that the generated gas can only flow away from the upper sub 110.

The cylinder 134 includes a bore 136 in which the shaft 138 is disposed. The bore 136 includes a smooth bore section 162 and the pressure dissipater 100. The smooth bore section 162 may be defined by an inner surface 164 that is dimensionally non-varying both circumferentially and axially. That is, the inner surface 164 conforms to a diameter that does not vary over a specified axial length. Additionally, the bore 136 includes a pressure chamber 153 that generates the pressure needed to displace the cylinder 134 in a direction away from the upper sub 110.

In one embodiment, the pressure chamber 153 may be formed using seals provided on the piston assembly 144. For example, the piston assembly 144 may include a head 150 that is connected to a mandrel 152. The pressure chamber 153 may be defined by one or more seals 154 positioned on the head 150 and one or more seals 155 disposed in the cylinder 134 that are positioned around the mandrel 152. The seals 154 may be elastomeric o-rings or other similar type of seals. Gas enters the pressure chamber 153 via passages 156 formed on the mandrel 152.

Figure 2:
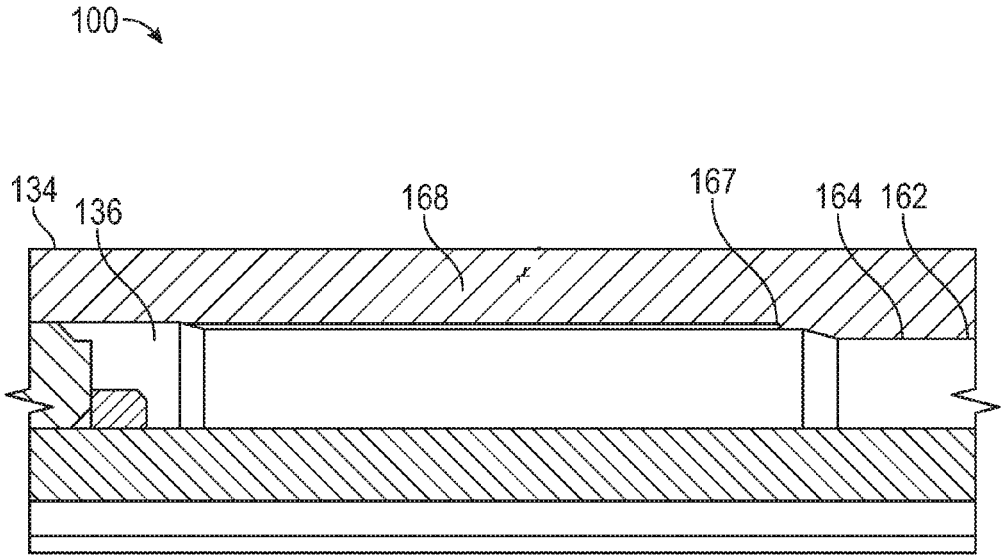
FIG. 2 is a sectional side view of a pressure dissipater for the gas energized well tool in accordance with one embodiment of the present disclosure.

The pressure dissipater 100 dissipates fluid pressure in the pressure chamber 153 after the cylinder 134 has moved axially, or stroked, a predetermined distance. Referring to FIG. 2, the pressure dissipater 100 physically destabilizes the seals 154 after the seals 154 exit the smooth bore section 162. By physically destabilized, it is meant that the body of the seals 154 are torn, ruptured, sheared, cut, shredded, or otherwise damaged to an extent that the seals 154 cannot maintain a fluid tight sealing contact with an adjacent surface. In one arrangement, the pressure dissipater 100, which may be located at or near a terminal end 166 of the cylinder 134, includes an enlarged diameter bore 167 along which a concave surface discontinuity 168 is formed. The enlarged diameter section 167 has a diameter greater than the diameter of the smooth bore section 162 and extends to the end of the terminal end 166.

Figure 3:
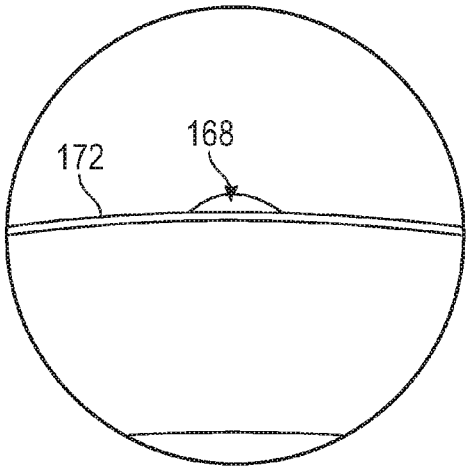
FIG. 3 depicts an end view of a concave surface discontinuity for the FIG. 2 pressure dissipater.
Figure 4:
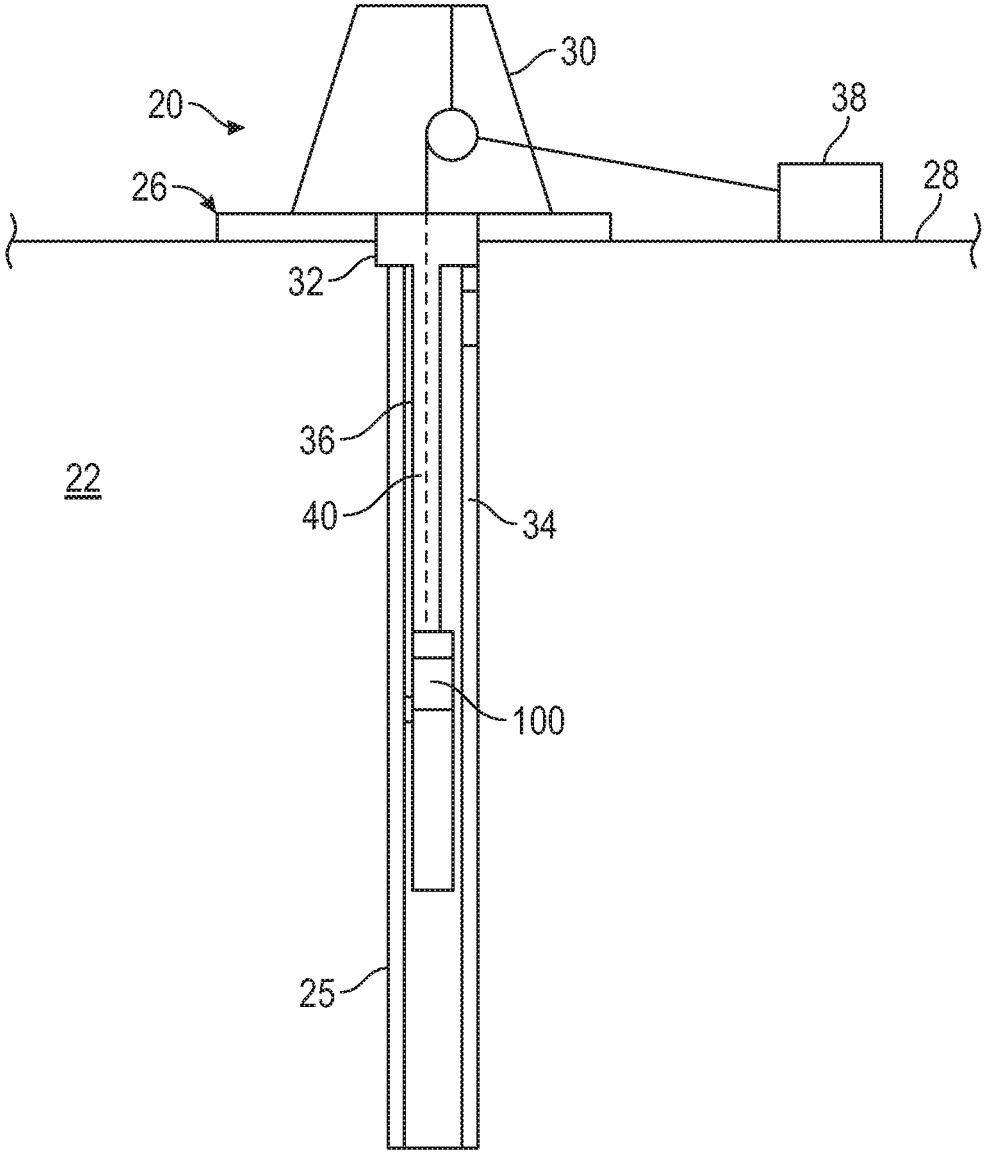
FIG. 4 schematically illustrates a well system that may deploy a gas energized well tool having a pressure dissipater in accordance with one embodiment of the present disclosure.

Referring now to FIG. 3, there is a cross-section shown of the pressure dissipater 100 that shows the concave surface discontinuity 168 in greater detail. In one embodiment, the concave discontinuity 168 may be a recess such as a groove, slot, or channel formed on an inner surface 172 that defines the enlarged diameter section 167. The discontinuity 168 may be straight or curved. The concave discontinuity 168 may be longitudinally aligned and have a length that may partially or completely traverse the enlarged diameter section 167. By longitudinally aligned, it is meant that discontinuity 168 is parallel with a longitudinal axis of the well tool 50 (FIG. 4), which is generally aligned with a wellbore 25 (FIG. 4). In other embodiments not shown, the discontinuity may be protrusion that projects from the inner surface 172. While one discontinuity 168 is shown, two or more discontinuities may be circumferentially spaced along the inner surface 172. Also, the surface discontinuity 168 may have rounded corners as shown or have sharp edges. The length and depth of the surface discontinuity 168 are selected to deform and damage the seals 154 sufficiently to allow high-pressure gas, and other fluids such as oil if present, to leak across the seals 154 and thereby bleed pressure from the pressure chamber 153.

Referring to FIG. 4, there is shown a well construction and/or hydrocarbon production facility 20 positioned over a subterranean formation of interest 22. The facility 20 can include known equipment and structures such as a platform 26 at the earth's surface 28, a rig 30, a wellhead 32, and cased or uncased pipe/tubing 34. A work string 36 is suspended within the wellbore 25 from the platform 26. The work string 36 can include drill pipe, coiled tubing, wire line, slick line, or any other known conveyance means. The work string 36 can include telemetry lines or other signal/power transmission mediums that establish one-way or two-way telemetric communication from the surface to the well tool 50 connected to an end of the work string 36. For brevity, a telemetry system having a surface controller (e.g., a power source) 38 adapted to transmit electrical signals via a cable or signal transmission line 40 disposed in the work string 36 is shown. The well tool 50 may be a device activated by gas pressure and may include a pressure dissipater 100.

Referring now to FIGS. 1-4, in one method of operation, the well tool 50 is conveyed into the wellbore 25 using the work string 36. After being positioned as desired, a suitable signal is transmitted to detonate the igniter 118. In one non-limiting arrangement, an electrical signal is conveyed via the cable 40. Alternatively, a pressure increase or drop bar may be used. The igniter 118 generates a flame output that ignites the power charge 146. The power charge 146 undergoes a deflagration that generates a high-pressure gas.

During operation, the power charge 146, when ignited, generates a high pressure gas that flows from the shaft bore 142 via the passages 156 into the pressure chamber 153. Because the seals 154 are intact, a relatively fluid tight seal prevents the high-pressure gas, and other gases or liquids, in the pressure chamber 153 from escaping. When the fluid pressure in the pressure chamber 153 is sufficiently high, the cylinder 134 is axially displaced in the direction shown by arrows 197 and activates the separate well tool (not shown). Initially, the seals 154 slide along the inner surface 164 of the smooth bore section 162 and the seals 155 slide along the mandrel 152. During the time the seals 154 are in the smooth bore section 162, the seals 154 are in a nominal sealing diameter.

Toward the end of the cylinder stroke, the seals 154 exit the smooth bore section 162 and enter the enlarged diameter section 167 of the pressure dissipater 100. Because of the larger bore diameter, the gas pressure in the chamber 153 can diametrically expand the seals 154. Upon expanding diametrically from the nominal sealing diameter, portions of the seals 154 flow or extrude into the surface discontinuities 168. As the seals 154 slide axially along the enlarged diameter section 167, the concave discontinuities 168 physically destabilizes the seals 154. That is, it is the physical contact between the seals 154 and the concave discontinuities 168 that causes the destabilization. Upon being destabilized, the ability of the seals to maintain a seal drops dramatically. Thus, gas leaks past the seals 154 and the fluid pressure in the chamber 153 drops. When the well tool 50 is now extracted from the wellbore 25, the pressure in the chamber 153 has bled down to dropped to a level that allows safe handling at the surface.

It should be understood that the present disclosure is susceptible to many embodiments. For instance, while a gas is described as the primary pressure source for moving the piston, a liquid may also be used. For example, a hydraulic oil may be used in a pressure chamber. Also, the movement of the piston may be modulated by metering the flow of the hydraulic oil through an orifice. In these embodiments, the hydraulic oil as well as the high pressure gas cooperate to move the piston and both are bleed from the tool after the seal is ruptured.

As used in this disclosure, the term "longitudinal" or "long" refers to a direction parallel with a bore of a tool or a wellbore. For example, the tool 100 has a longitudinal axis that is parallel with the longitudinal axis of the wellbore.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. Thus, it is intended that the following claims be interpreted to embrace all such modifications and changes.

We claim:

1. A well tool, comprising:

an upper sub having a housing that includes a first chamber for receiving an igniter, the igniter generating a flame output when detonated;

a pressure sub having:

a cylinder having an inner surface defining a bore, the cylinder bore having:

a smooth bore section defined by an inner surface that is dimensionally non-varying both circumferentially and axially, and a pressure chamber that generates the pressure needed to displace the cylinder in a direction away from the upper sub, and a shaft disposed in the cylinder bore, the shaft having a bore, a first end connected to the upper sub, and a second end on which a piston assembly is formed, the piston assembly including at least one seal contacting the inner surface of the cylinder, a power charge disposed in the shaft bore, the power charge being formed of an energetic material that generates a gas when ignited by the flame output of the igniter, and a pressure dissipater formed at a terminal end of the cylinder, the pressure dissipater contacting and physically destabilizing the at least one seal after the at least one seal exits the smooth bore section; and a lower sub connected to the cylinder and configured to axially displaces a component of a separate wellbore device.

2. The well tool of claim 1, wherein the piston assembly includes a head that is connected to a mandrel and at least one additional seal positioned around the mandrel, wherein the at least one seal is positioned on the head, and wherein the gas enters the pressure chamber via passages formed on the mandrel.

3. The well tool of claim 1, wherein the pressure dissipater is configured to dissipate a fluid pressure in the pressure chamber after the cylinder has moved axially a predetermined distance relative to the shaft.

4. The well tool of claim 3, wherein the pressure dissipater physically destabilizes the at least one seal by at least one of: tearing, rupturing, shearing, cutting, and shredding.

5. The well tool of claim 1, wherein the pressure dissipater includes an enlarged diameter section formed adjacent to the smooth bore section, the enlarged diameter section having a diameter greater than the diameter of the smooth bore section and a concave surface discontinuity formed thereon.

6. The well tool of claim 5, wherein the concave surface discontinuity is a recess formed on an inner surface that defines the enlarged diameter section.

7. The well tool of claim 6, wherein the recess is aligned with a longitudinal axis of the well tool and at least partially traverses the enlarged diameter section.

8. The well tool of claim 7, wherein the recess is one of: a groove, a slot, and a channel.

9. The well tool of claim 7, wherein the pressure dissipater is configured to dissipate a fluid pressure in the pressure chamber after the cylinder has moved axially a predetermined distance relative to the shaft, and wherein the predetermined distance is at least a distance necessary to allow the at least one seal to slide through the smooth bore section and the enlarged diameter section.

10. An apparatus for activating a wellbore tool, comprising:

a cylinder having a first inner surface defining a smooth bore section and a second inner surface adjacent to the first inner surface;

a shaft having a piston section that includes at least one seal forming a fluid seal with the first inner surface when the seal is at a nominal diameter; and a pressure dissipater formed along the second inner surface of the cylinder, the pressure dissipater contacting and physically destabilizing the at least one seal after the at least one seal exits the smooth bore section, wherein the pressure dissipater includes an enlarged diameter section defined by the second inner surface and a surface discontinuity formed on the second inner surface of the cylinder, wherein the enlarged diameter section has a larger diameter than the smooth bore section, and wherein the surface discontinuity is concave recess extending longitudinally along at least a portion of the enlarged diameter section.

11. The apparatus of claim 10, wherein the pressure dissipater includes a plurality of surface discontinuities circumferentially distributed on the second inner surface.

12. The apparatus of claim 10, wherein the pressure dissipater is configured to dissipate a fluid pressure in the pressure chamber after the cylinder has moved axially a predetermined distance relative to the shaft, and wherein the predetermined distance is at least a distance necessary to allow the at least one seal to slide through the smooth bore section and the enlarged diameter section.

* * * * *